US005729812A

United States Patent [19]

Moser

[11] Patent Number: 5,729,812

[45] Date of Patent: Mar. 17, 1998

[54] HEAT AND PRESSURE FUSER UTILIZING RIGID ROLLS AND BELTS TO FORM AN EXTENDED CONTACT ZONE BETWEEN THE BELTS INCLUDING PREHEAT AND PRESSURE ZONES

[75] Inventor: Rabin Moser, Victor, N.Y.

[73] Assignee: Xerox Corporation, Stamford, Conn.

[21] Appl. No.: 720,640

[22] Filed: Oct. 2, 1996

[51] Int. Cl.[6] ..... G03G 15/20

[52] U.S. Cl. ..... 399/329; 219/216

[58] Field of Search ..... 399/329, 122, 399/328, 320, 67, 68; 219/216

[56] References Cited

U.S. PATENT DOCUMENTS

| | | | |
|---|---|---|---|
| 3,810,735 | 5/1974 | Moser | 432/59 |
| 3,948,215 | 4/1976 | Namiki | 118/60 |
| 4,242,566 | 12/1980 | Scribner | 219/216 |
| 4,563,073 | 1/1986 | Reynolds | 355/3 FU |
| 4,565,439 | 1/1986 | Reynolds | 355/3 FU |
| 5,053,829 | 10/1991 | Field et al. | 355/290 |
| 5,157,444 | 10/1992 | Mori et al. | 355/282 |
| 5,250,998 | 10/1993 | Ueda et al. | 355/285 |
| 5,300,997 | 4/1994 | Herabayashi et al. | 355/285 |
| 5,311,269 | 5/1994 | Aslam et al. | 399/329 |
| 5,321,480 | 6/1994 | Merle et al. | 355/285 |
| 5,349,424 | 9/1994 | Dalal et al. | 355/285 |
| 5,483,331 | 1/1996 | Wayman et al. | 355/285 |

*Primary Examiner*—Arthur T. Grimley
*Assistant Examiner*—Quana Grainger

[57] ABSTRACT

A combination dual hard roll and dual elastomeric belt fuser. A pair of hard, heated fuser rolls having elastomeric belts entrained thereabout are supported such that segments of the belts are sandwiched in a nip area therebetween. The belt segments are sufficiently thick to provide belt conformability resulting in high quality fused images. One of the belts is partially wrapped about one of the rigid rolls to form an extended heating zone and a combination heat and pressure zone through which substrates carrying toner images are moved.

7 Claims, 1 Drawing Sheet

HEAT AND PRESSURE FUSER UTILIZING RIGID ROLLS AND BELTS TO FORM AN EXTENDED CONTACT ZONE BETWEEN THE BELTS INCLUDING PREHEAT AND PRESSURE ZONES

BACKGROUND OF THE INVENTION

This invention relates generally to xerographic copying apparatus, and more particularly, it relates to the heat and pressure fixing of particulate thermoplastic toner carried by a substrate which is passed between a pair of heated, elastomeric belts entrained about a pair of hard fuser rolls forming a pressure nip with the belts sandwiched therebetween.

In the process of xerography, a light image of an original to be copied is typically recorded in the form of a latent electrostatic image upon a photosensitive member with subsequent rendering of the latent image visible by the application of electroscopic marking particles, commonly referred to as toner. The visual toner image can be either fixed directly upon the photosensitive member or transferred from the member to another support, such as a sheet of plain paper, with subsequent affixing of the image thereto in one of various ways, for example, as by heat and pressure.

In order to affix or fuse electroscopic toner material onto a support member by heat and pressure, it is necessary to elevate the temperature of the toner material to a point at which the constituents of the toner material coalesce and become tacky while simultaneously applying pressure. This action causes the toner to flow to some extent into the fibers or pores of support members or otherwise upon the surfaces thereof. Thereafter, as the toner material cools, solidification of the toner material occurs causing the toner material to be bonded firmly to the support member. In both the xerographic as well as the electrographic recording arts, the use of thermal energy and pressure for fixing toner images onto a support member is old and well known.

One approach to heat and pressure fusing of electroscopic toner images onto a support has been to pass the support with the toner images thereon between a pair of opposed roller members, at least one of which is internally heated. During operation of a fusing system of this type, the support member to which the toner images are electrostatically adhered is moved through the nip formed between the rolls with the toner image contacting the fuser roll thereby to effect heating of the toner images within the nip. With this type of arrangement, the temperature profile of the toner images as they pass through the nip increases continuously to a maximum while the pressure profile is symmetrical. In other words, the nip pressure increases from zero at the nip entrance to a maximum pressure approximately half way through the nip and then to zero at approximately the nip exit. A plot of nip pressure versus position in the nip yields a somewhat parabolic shape. A symmetrical pressure profile results in the application of high pressure to toner which is not yet in a molten state.

With the requirement for faster process speeds and, therefore, faster fusing speeds, it becomes more and more difficult to obtain adequate fusing nips using roll fusers. This is because the nip width varies approximately as the square root of the roll diameter. Thus, for example, doubling the process speed would require double the nip width which, in turn, would increase the fuser and pressure roll diameters by a factor of four. In addition, larger rolls require higher loads and produce an inferior release geometry. The foregoing drawbacks do not apply to belt fusers. Thus, belt fusers of the prior art have been provided with larger nip areas in order to allow faster fusing speeds. However, all known prior devices, with the exception of the fuser disclosed in U.S. Pat. No. 5,053,829, inherently waste mechanical energy due to the mismatch of peak pressure with peak temperatures.

Following is a discussion of prior art, incorporated herein by reference, which may bear on the patentability of the present invention. In addition to possibly having some relevance to the question of patentability, these references, together with the detailed description to follow, may provide a better understanding and appreciation of the present invention.

Belt fusers are known in the prior art. For example, U.S. Pat. Nos. 4,563,073 and 4,565,439 each disclose a heat and pressure fusing apparatus for fixing toner images. The fusing apparatus is characterized by the separation of the heat and pressure functions such that the heat and pressure are effected at different locations on a thin flexible belt forming the toner contacting surface. A pressure roll cooperates with a stationary mandrel to form a nip through which the belt and copy substrate pass simultaneously. The belt is heated such that when it passes through the nip its temperature together with the applied pressure is sufficient for fusing the toner images passing therethrough. A release agent management (RAM) system comprising low mass donor and metering rolls, one of which is in contact with the belt, applies silicone oil to the belt without unacceptably reducing the fusing capability of the belt. As may be appreciated such belt fusers as these are limited to low volume and therefore low fusing speed applications.

U.S. Pat. No. 5,483,331 granted to Wayman et al discloses a fuser comprising three fuser rollers cooperating with a pressure roller to form an extended fusing zone through which an electrically resistive substrate carrying toner images passes with the toner images contacting fusing belt. Electrical power is applied to the three fuser rolls in such a manner that only the portions of the belt between the rollers are heated. The energy is concentrated only in the part of the fusing belt where it is needed for fusing the toner images on the final substrate. Thus free extent of the belt or in other words the portion of the belt outside of the fusing zone remains unheated. To ensure good electrical contact in the presence of silicone oil contamination on the inner surface of the fusing belt the contact rollers are textured by knurling, bead blasting or other suitable techniques. Such treatment produces high and low surface areas, the former providing the good electrical contact.

U.S. Pat. No. 5,349,424 granted to Dalal et al discloses a heated thick walled belt fuser for an electrophotographic printing machine. The belt is rotatably supported between a pair of rolls. One of the spans of the belt is in contact with a heating roll in the form of an aluminum roll with an internal heat source such as a quartz lamp. The belt is able to wrap a relatively large portion of the heating roll to increase the efficiency of the heat transfer. The second span of the belt forms an extended fusing nip with a pressure roll. The extended nip provides a greater dwell time for a sheet in the nip while allowing the fuser to operate at a greater speed. External heating enables a thick profile of the belt, which in turn allows the belt to be reinforced so as to operate at greater fusing pressures without degradation of the image. The thick profile and external heating of the belt also provides a much more robust design than conventional thin walled belt fusing systems.

U.S. Pat. No. 5,321,480 granted to Merle et al discloses a fuser for fusing toner images to a receiving sheet including a pressure roller and a fusing belt. The fusing belt has leading and trailing ends. A towing device is positioned to receive both the leading and trailing ends of the belt to form an endless belt. The towing device is moved through a path which moves the fusing belt through an endless path, which path includes a fusing nip with the pressure roller. The belt is backed by a heated roller at the fusing nip which defines a portion of the endless path and cooperates with the pressure roller to provide pressure in the nip.

U.S. Pat. No. 5,300,997 granted to Hirabayashi et al discloses an image fixing apparatus including a heater; a sheet in slidable contact with the heater; and a back-up member cooperative with the heater to form a nip therebetween such that the sheet is interposed in the nip. An unfixed image on a side of a recording material in contact with the sheet is heated and fixed by heat from the heater through the sheet. The sheet includes (i) a base resin layer in slidable contact with the heater, and (ii) a surface parting layer disposed on the base resin layer. The surface parting layer is thinner than the base resin layer.

U.S. Pat. No. 5,250,998 granted to Ueda et al discloses a toner image fixing device, wherein there are provided an endless belt being looped up around a heating roller and a conveyance roller, a pressure roller for pressing a sheet having a toner image onto the heating roller with the endless belt intervening between the pressure roller and the heating roller. A sensor is disposed inside the loop of the belt so as to come in contact with the heating roller, for detecting the temperature of the heating roller. The fixing temperature for the toner image is controlled on the basis of the temperature of the heating roller detected by the sensor. A first nip region is formed on a pressing portion located between the heating roller and the fixing roller. A second nip region is formed between the belt and the fixing roller, continuing from the first nip region but without contacting the heating roller.

U.S. Pat. No. 5,157,444 granted to Mori et al discloses a lateral shift control apparatus for an endless belt including a lateral shifting driver for applying to the endless belt a lateral shifting force in lateral directions; a switching device for switching direction of the lateral shifting force; a detector for detecting a lateral end position of the endless belt; and a controller responsive to an output of the detector to control the switching device. The lateral end portion detected by the detector is pro,tided with an inclined portion.

U.S. Pat. No. 3,810,735 granted to Rabin Moser discloses a fixing system for fixing fusible material such as electroscopic particles to a support material. The system includes at least one fuser member in the form of an endless belt in pressure contact with another fuser member and between which the support material is transported. The fusing belt member is provided with a heat barrier blanket and is coated a release agent that will prevent "offset" of the particles being fused.

U.S. Pat. No. 5,053,829 granted to Field et al on Oct. 1, 1991 discloses a heat and pressure fusing apparatus for fixing toner images to substrates such as plain paper, the toner comprising a thermoplastic resin. The apparatus includes two nip forming members which cooperate to form a nip having an asymmetrical pressure profile. Thus, the pressure profile through the nip, from entrance to exit, is such that toner images on a substrate passing through the nip are first subjected to relatively low pressure which continues until the toner begins to flow. Once toner flow commences, the images are subjected to pressure high enough to force the toner into the substrate.

BRIEF SUMMARY OF THE INVENTION

In roll fusers, a significant portion of the contact zone is used to increase the toner temperature to enable toner flow and to fix it to a substrate such as plain paper. In the fusing process, the time available to enable fusing is very short. If toner and paper are heated adequately then a short pressure pulse is sufficient.

In the fuser of the present invention which is designed to utilize belts which cooperate with rigid rolls to provide an extended contact zone including a long preheat zone, a short high pressure zone is adequate for achieving fix and soft roll conformability. This obviates the need for thick rubber coatings on Nip Forming Fuser Roll (NFFR) or Nip Forming Pressure Roll (NFPR) fusers. A rubber thickness of approximately 0.020 inch provided by two fusing belts entrained about two pressure engaged fuser rolls is sufficient to provide the intimate preheat contact and the pressure required in the fusing nip.

With such a belt arrangement "life of machine" rolls can be used in a fuser requiring only periodic, inexpensive belt replacement. Such a fuser provides a significant improvement in reliability as well as service costs compared to conventional roll fusers. Also, because of the significant reduction (from 1000 lbs. @ 120 cpm for conventional roll fusers to <100 lbs. for the present configuration) in the total load, much lower drive torques are required. Lower fuser roll drive torques reduce the adverse motion caused by conventional roll fusers on the machines in which they are utilized.

DETAILED DESCRIPTION OF THE DRAWING

PREFERRED EMBODIMENT OF THE INVENTION

Figure 1:
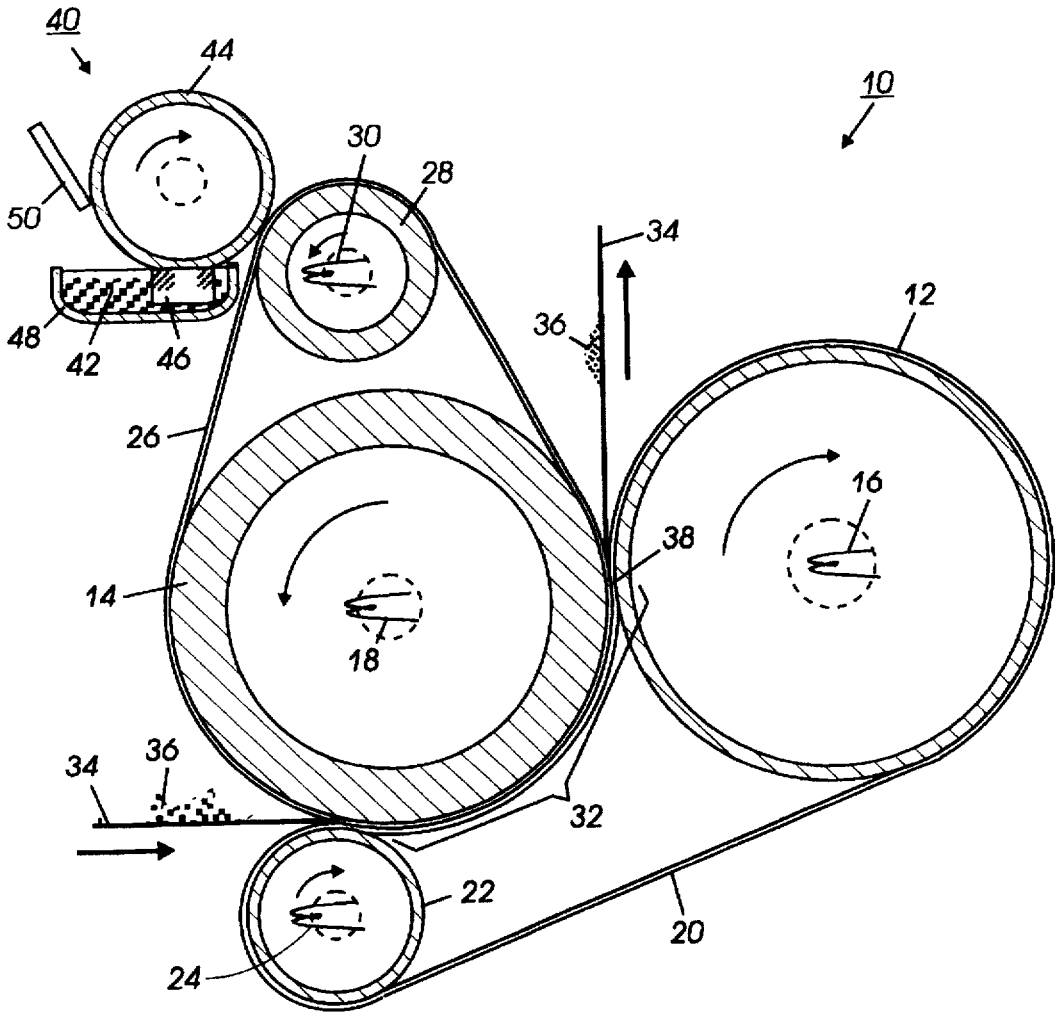
FIG. 1 illustrates a combination dual, hard or rigid roll and dual elastomeric belt fuser.

Referring now to FIG. 1, it can be seen that the invention is directed heat and pressure fuser 10 comprising a pair of rigid, nondefomable rolls 12 and 14. The rigid rolls 12 and 14 are provided with internal heat sources 16 and 18.

A first elongated fusing member in the form of an elastomeric belt 20 is entrained about the rigid roll 12 and a support roll 22. An internal auxiliary heat source 24 is provided for elevating the temperature of the roll 22 and, in turn, the first elastomeric belt 20.

A second elongated fusing member in the form of an elastomeric belt 26 is entrained about the roll 14 and a support roll 28. An auxiliary heat source 30 supported internally of the support roll 28 serves to elevate the temperature of that roll and, in turn, the belt 26. The elastomeric belts have a combined thickness of approximately 0.020 inch with each belt being of approximately equal thickness. Each belt may have a thickness in the order of 0.01 to 0.06 inch. The belt widths are approximately 20 inches. The belts may be fabricated using an elastomeric, abhesive material such as silicone rubber or Viton™. By abhesive is meant, having a low affinity for toner adherence or having a low surface energy in the presence of suitable release agents.

The rigid rolls 12 and 14 are supported in pressure engagement by conventional means, not shown. They are also supported in a conventional manner for rotation by conventional drive mechanism known in the art of fusing. Portions of the first and second elastomeric belts are sandwiched between the rolls 12 and 14.

Figure 2:
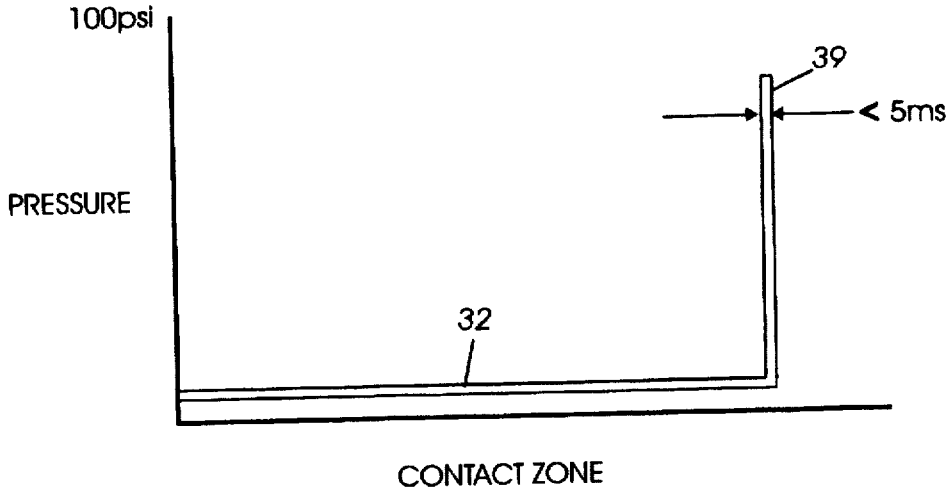
FIG. 2 depicts a plot of pressure versus substrate contact points in the fuser of FIG. 1, expressed in milliseconds.

An extended area of contact or contact zone indicated by reference character 32 is formed between the belts 20 and 26. A copy substrate such as plain paper 34 carrying toner images 36 moves through the extended contact zone 32 for fusing of the toner images. The extended contact zone provides preheating of the toner images and copy substrate prior to physical pressure being applied to the toner forming the images. The extended contact zone 32 provides in the order of 50 to 200 ms of contact between the substrate 34 and the heated belts prior to entering a pressure zone 38. The zone 38 coincides with the area of contact between the two belts 20 and 26 at an area where the rolls 12 and 14 are oppositely disposed. As shown in FIG. 2, a pulse of pressure denoted by reference character 39 is of short duration, approximately 5 ms, compared to the duration of substrate and toner image contact in the contact zone 32.

A temperature sensor, not shown, serves to sense the surface temperature of the roll structure 12, by way of example, and in conjunction with conventional circuitry (not shown) maintains the surface temperature to a predetermined value, for example, on the order of 325°–400° F.

Such a temperature sensor controls the On/Off duration of the heat sources 16, 18, 24 and 30. The aforementioned heat sources may comprise radiant quartz heaters of the type conventionally utilized in heat and pressure fusers. When suitably energized via the aforementioned circuitry, the heat sources serve to raise the fuser 10 to an equilibrium temperature at which toner fusing may be accomplished. This is accomplished very quickly due to the absence of unheated fusing members that would act as heat sinks.

The heat sources 24 and 30 preclude the rolls 22 and 28 from acting as heat sinks as well as serving to preheat the elastomeric belts 20 and 26. By providing heat sources in each of the rolls 12, 14, 22 and 28, the heat and pressure fuser 10 is capable of reaching operating temperature equilibrium very rapidly.

A Release Agent Management (RAM) system generally indicated by reference character 40 serves to apply release agent material such as silicone oil 42 to the surface of the fusing belt 26 which is contacted by the toner images 36 carried by the substrate 34. The RAM further comprises a metering roll 44 supported for rotation in contact with a wick 46 immersed in the silicone oil 42 which oil is contained in a sump 48. A metering blade 50 serves to meter the silicone uniformly on the surface of the metering roll 44. While as shown, the metering roll is adapted to be rotated through frictional engagement with the belt 26 a positive drive mechanism well known in the art may alternatively be employed.

The wick 46 is fully immersed in the release agent material 42 and contacts the surface of the metering roll 44. The purpose of the wick is to provide an air seal which disturbs the air layer formed at the surface of the metering roll during rotation thereof. Without the presence of the wick, the air layer would be coextensive with the surface of the metering rolls immersed in the release agent thereby precluding contact between the metering rolls and the release agent.

The metering blade 50 is preferably fabricated from Viton is ¾×⅛ in cross section and has a length coextensive with the metering roll. The edge of the blade contacting the metering roll 42 has a radius of 0.001–0.010 inch. The blade functions to meter the release agent picked up by the metering roll to a predetermined thickness, such thickness being of such a magnitude as to result in several microliters of release agent consumption per copy.

In summary, the roll fuser of the present invention as described above which is designed to utilize belts for fusing, a short high pressure zone is adequate for achieving fix and soft roll conformability. This obviates the need for thick rubber coatings on Nip Forming Fuser Roll (NFFR) or Nip Forming Pressure Roll (NFPR) fusers. A rubber thickness of approximately 0.020 inch provided by the two fusing belts entrained about two pressure engaged fuser rolls provides the intimate contact and pressure required in the fusing nip to produce high quality toner images. With such a belt arrangement "life of machine" rolls can be used in a fuser requiring only periodic, inexpensive belt replacement. Such a fuser provides a significant improvement in reliability as well as service costs compared to conventional roll fusers. Also, because of the significant reduction (from 1000 lbs. @ 120 cpm for conventional roll fusers to <100 lbs. for the present configuration) in the total load, much lower drive torques are required. Lower fuser roll drive torques reduce the adverse motion caused by conventional roll fusers on the machines in which they are utilized.

What is claimed is:

1. A heat and pressure fuser apparatus, said apparatus comprising:

a first pair of rigid rolls:

a first belt structure entrained about said first pair of rigid rolls;

a second pair of rigid rolls;

a second belt structure entrained about said second pair of rigid rolls;

means for heating said first and second belts;

said first and second pairs of rolls and said and said first and second belt structures being supported such that a roll of one of said first and second pairs of rolls is pressure engaged, through both of said belts, with each roll of another pair of said first and second pairs of rolls to thereby form an extended contact zone including a preheat zone and a pressure zone.

2. Apparatus according to claim 1 wherein said heating zone provides in the order of 50 to 200 ms of contact between said belts.

3. Apparatus according to claim 2 wherein said combination heating and pressure zone provides less than 5 ms of contact.

4. Apparatus according to claim 3 including a RAM system for applying release agent material to said one of said belts for precluding offset of toner thereto.

5. Apparatus according to claim 4 wherein a combined thickness of said belts is in the order of 0.005 to 0.60 inch.

6. Apparatus according to claim 1 wherein said means for heating said belts comprises sources of energy disposed internally of at least some of said rigid rolls.

7. Apparatus according to claim 1 wherein said means for heating said belts comprises sources of energy disposed internally of all of said rigid rolls.

* * * * *